United States Patent [19]

Heinrich et al.

[11] 3,995,004

[45] Nov. 30, 1976

[54] PROCESS FOR THE MANUFACTURE OF FILAMENT YARN HAVING PROTRUDING FILAMENT ENDS

[75] Inventors: Karl Heinrich; Klaus-Dieter Scholz, both of Bobingen, Germany

[73] Assignee: Hoechst Aktiengesellschaft, Frankfurt am Main, Germany

[22] Filed: Mar. 12, 1974

[21] Appl. No.: 450,439

[30] Foreign Application Priority Data

Mar. 17, 1973 Germany ..... 2313474

[52] U.S. Cl. ..... 264/151; 19/.3; 19/.37; 264/167; 264/210 F; 264/237; 264/290 T; 264/290 R; 428/399

[51] Int. Cl.[2] ..... B29C 17/00; D01D 5/20

[58] Field of Search ..... 264/167, 168, 210 F, 264/151, 176 F, 290, 237, 290 T; 19/.3, .37; 428/399

[56] References Cited

UNITED STATES PATENTS

| | | | |
|---|---|---|---|
| 2,244,281 | 6/1941 | Alibert | 264/207 |
| 2,313,630 | 3/1943 | Dockerty | 264/168 |
| 2,435,891 | 2/1948 | Lodge | 264/168 |
| 2,708,813 | 5/1955 | Bourgeaux | 264/210 Z |
| 2,975,474 | 3/1961 | Smith | 264/167 |
| 3,069,726 | 12/1962 | Adams | 264/290 |

*Primary Examiner*—Jay H. Woo
*Attorney, Agent, or Firm*—Connolly and Hutz

[57] ABSTRACT

A process is provided for the manufacture of filament yarn having protruding filament ends on the basis of synthetic high polymers by melt spinning of the polymers through spinning nozzles, which comprises subjecting the multifilaments still hot after having left the spinning nozzle to a section cooling which causes determined sections of the single filaments to have a different molecular structure, and by subsequently drawing the filaments in a ratio which is greater than corresponding to those filament sections having a lower drawing ratio, and smaller than corresponding to those filament sections having a higher drawing ratio, thus causing the formation of determined breaks which supply the desired fiber ends.

3 Claims, 2 Drawing Figures

PROCESS FOR THE MANUFACTURE OF FILAMENT YARN HAVING PROTRUDING FILAMENT ENDS

The present invention relates to a process for the manufacture of hair yarn from filaments consisting of linear synthetic high polymers by melt spinning of the polymers through spinning nozzles.

Filaments of synthetic high polymers are normally of a smooth nature and are processed to correspondingly plain woven or knitted fabrics which do not have the soft touch of woven or knitted fabrics made from spun fiber yarns. Obviously, the protruding ends of fiber yarns are decisive for the subjective estimation of textile shaped articles.

Therefore, a great number of processes for the manufacture of filament yarns having protruding filament ends, so-called hair yarns, have been developed, for example the process described in German Auslegeschrift No. 1,263,217, where filament yarns are mixed in an interlacing jet with yarns made from staple fibers. German Offenlegungsschrift No. 1,660,606 describes a process for the manufacture of such hair yarns, which comprises ripping and unravelling mechanically the surface of a drawn continuous filament by the action of rotating brushes. This process, however, is limited to foamed thermoplastic polymers, and it is obviously applicable to coarse yarns only.

Furthermore, it has been proposed to draw simultaneously filaments of different elongation in such a manner that one of the components breaks, thus resulting in a filament having protruding ends, such as it is described in British Pat. No. 924,086. In this process, however, generally all filaments of the lower elongation break at one distinct spot of the yarn, so that a bunchy structure is the result instead of a uniform distribution of single filament ends over the whole filament surface.

The object of the present invention is therefore to provide a process for the manufacture of multifilament yarns on the basis of synthetic high polymers, which yarns have fine protruding filament ends uniformly distributed over the surface of the filament yarn.

The object of this invention is accomplished by subjecting the multifilaments still hot after having left the spinning nozzle to a sectional cooling which causes determined sections of the single filaments to have a different molecular structure, and by subsequently drawing the filaments in a ratio which is greater than corresponding to those filament sections having a lower drawing ratio, and smaller than corresponding to those filament sections having a higher drawing ratio, thus causing the formation of determined breaks which supply the desired fiber ends.

In a special embodiment of the present invention, the filaments still hot when leaving the spinning nozzle, up to 1 m, preferably 50 cm, and especially 25 cm, after having attained the solidification point, are passed and spread out over the cooled surface of a profiled roller, the circumferential speed of which being the same as the speed of the running filaments, which causes determined sections of the single filaments to contact intensely the surface of the profiled roller for a determined period and thus to obtain another molecular structure than those filament sections not being in contact with the roller, and subsequently they are drawn in a ratio greater than corresponding to those filament sections having a lower drawing ratio, and smaller than corresponding to those filament sections having a higher drawing ratio, thus causing the formation of determined breaks supplying the desired fiber ends.

According to a further special embodiment of the process of the invention, the filaments are passed over a cooled profiled roller constructed as regular cylinder having helical grooves and ridges on the surface of its casing, which cylinder rotates with uniform angular velocity round its axis of symmetry arranged horizontally and parallelly to the plane of the filaments running parallelly one to the other, so that these filaments contact this regular cylinder longitudinally to a generating line.

The process of the invention is suitable for all melt spun filaments and may be carried out in all commercial melt spinning devices by adding a profiled roller.

By cooled profiled roller, there is to be understood any body the surface temperature of which is maintained at a temperature below the filament temperature at the place of contact, and which body is moved in such a manner that, at the place of contact with the filaments, the surface speed of the body is identical to the filament speed with respect to rate and direction, the surface of which body however being adjusted in such a manner that it contacts the filaments not over their complete length, but only sectionally. The identical speed of roller and filaments ensures that in fact only determined sections of the hot filaments touch the cooled profiled roller.

Since in melt spinning devices the filaments generally are drawn off vertically from top to bottom, as profiled roller there are preferred such bodies which rotate around a spatially fixed horizontal axis with constant angular velocity. The melt spun filaments generally pass parallelly one to the other over the surface of the cooled profiled roller, that is, they are not twisted or gathered, but spread out.

The special shape of the profiled roller is adapted to the requirements put on the filament and depends on the filament and yarn titer, the raw material and the spinning speed. The dimensions, the distribution and number of the contact areas of the filaments and the profiled roller are determined according to the desired distribution and number of the defined breaks.

The residence time of the filament sections on the surface of the profiled roller may be determined by a corresponding choice of the radius and the angle of contact, and of course of the draw-off speed.

The cooled profiled roller may also be replaced by cooling the sections of the still hot filaments in another manner, for example by an intermittent blowing with cold gases.

The invention will be better understood by reference to the drawing, which, however, shows only one of the numerous possibilities for carrying out the process of the invention.

In this drawing.

Figure 1:
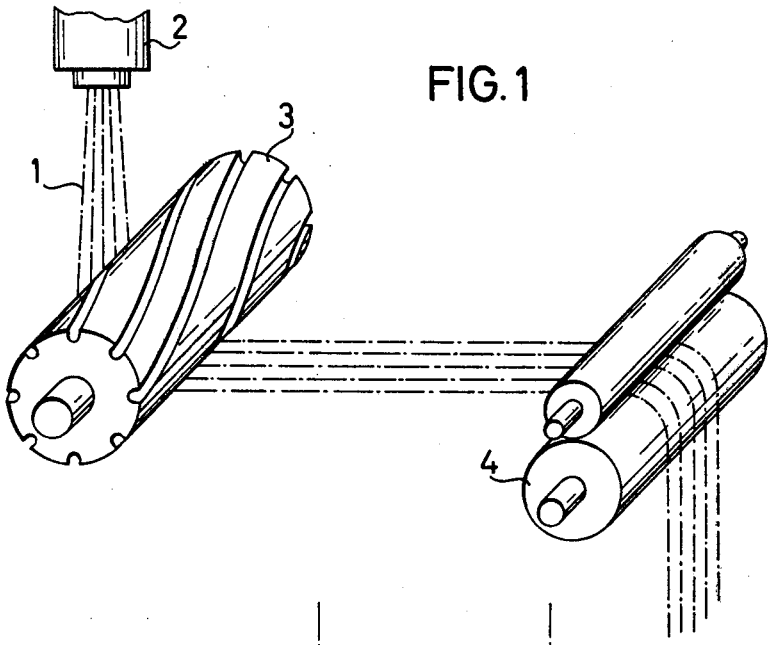
FIG. 1 is a principle sketch of a spinning device for carrying out the process of the invention.

Referring now to FIG. 1, it shows how the filaments 1, after having left the melt spinning nozzle, are passed, in an essentially parallel position, over the profiled roller 3, the circumferential speed of which corresponds to that of the draw-off roller 4.

Determined filament sections are in close contact with the profiled roller 3 and essentially acquire its surface temperature, while the non-touched filament sections cool more slowly in the surrounding air. It may be advantageous to stabilize the filaments between spinning nozzle 2 and profiled roller 3 by a transversal air current.

The temperature of the cooled profiled roller is generally chosen as low as possible, but above the dew point of the surrounding air, in order to avoid damping.

The cooled profiled roller is mounted as near as possible to the melt spinning nozzle in order to attain a maximum orientation difference between touching and non-touching filament sections. Of course, the temperature must be below the solidification point of the filaments, since otherwise they would stick to the surface of the roller. The solidification point may be determined by simple testing: by solidification point there has to be understood that spot of the filament length where the filament does not stick any more to the surface of the cooled profiled roller.

When the filaments, during the spinning process, are observed under polarized light, a sudden start of the optical double refraction, that is, the orientation of the filament molecules in a distance from the spinning nozzle exactly detectable, can be observed. Therefore, the cooled profiled roller has to be advantageously mounted before this start of the double refraction, since in this case it may cause especially marked orientation differences over the filament length.

Figure 2:
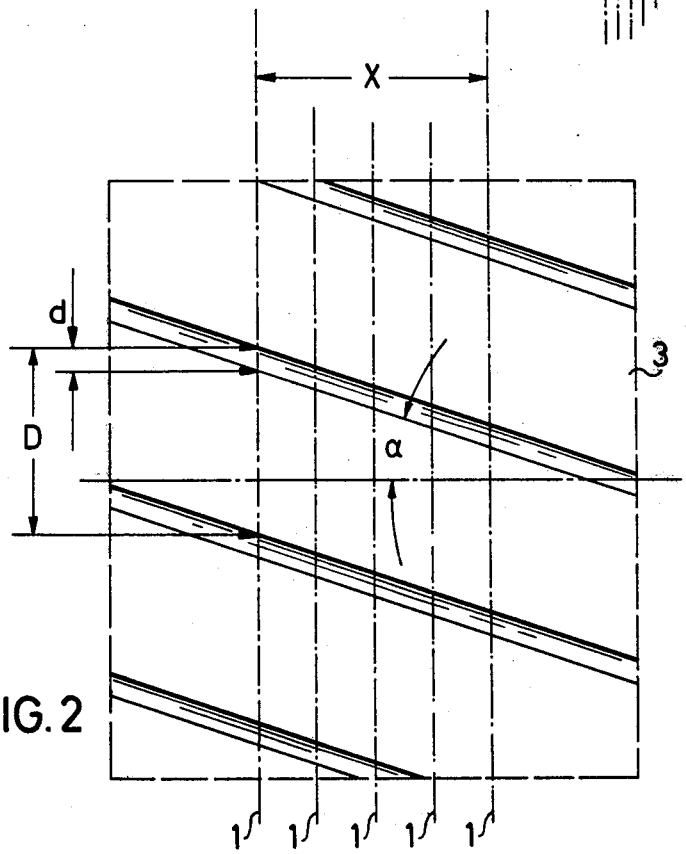
FIG. 2 shows as an example a layout of the surface of the profiled roller 3, and how the filament distance, in case of a given profiled roller, has to be chosen in order to obtain a multifilament having the desired protruding filament ends.

FIG. 2 shows a preferred embodiment of the profiled roller. The helical grooves ensure that not all of the filaments touch the roller at one spot of the multifilament, but that the points of contact are distributed over the complete multifilament length.

When the cooled profiled roller, as FIG. 2 shows, is constructed as regular cylinder having helical grooves and ridges, it is especially advantageous to spread out uniformly the strand of filaments to a width X, so that this width X is smaller than the quotient from the width of the ridge (D—$d$) to the tangent of the angle $\alpha$; $\alpha$ being the acute angle between the direction of the ridges and the perpendicular onto the filaments. The width X is advantageously greater than the quotient from groove width d to tangent of angle $\alpha$.

After having left the cooled profiled roller, the filaments 1 are gathered, provided with a finish and wound up on bobbins in known manner after having passed over draw-off rollers. These bobbins may be supplied to commercial drawtwisters and subjected to the drawing ratio which corresponds to the filament sections having the higher drawability.

At the filament sections having a low drawability, this drawing ratio causes a break and thus provides two free filament ends. However, the multifilaments may also be twisted or interlaced before being drawn, and a simultaneous drawing and false-twist texturizing according to British Pat. application No. 777,625 is also possible.

The advantages of the process of the invention are obvious: The filaments may be manufactured in already existing melt spinning devices according to known processes, for example according to German Pat. No. 973,553; the device must only be completed by a cooled profiled roller. These facts also ensure that there are no restrictions with respect to the filament or multifilament titer as compared to a normal multifilament, whereas, in many known processes, the gathering of filaments having different elongation at break values causes an increase of the minimum multifilament titer. The frequency of filament ends may be chosen by the construction of the profiled roller according to the desired application; by the degree of interlacing or twisting, the character of the yarn may be determined in that the fine filament ends are more or less firmly integrated.

It is especially advantageous to pass only part of the filaments over the cooled profiled roller and to homogeneously cool the other part in known manner. According to the process, part of the filaments remain continuous. Also two multi-filaments may be gathered, one of which only is manufactured according to the process of the invention.

However, hair yarns manufactured according to the present invention show the tendency to pilling known also from spun fiber yarns of synthetic high polymers, which tendency is troublesome in many applications. Also in this case, advantageously such polymers are used which provide filaments having a low tendency to pilling. All those filaments are preferred which either have already a sufficient lateral bending resistance (Knickscheuerbestandigkeit) of below 1500 cycles, or the lateral bending resistance of which may be lowered accordingly by suitable known measures.

Preferred are those filaments the lateral bending resistance of which is less than 1000 cycles, especially less than 500 cycles. The lateral bending resistance value has an influence on the number of the protruding filament ends; the filaments having the poorest lateral bending resistance breaking rather by transverse stress in the further processing, such as twisting or texturizing. The number of protruding filament ends may also be influenced by the amount of filaments having a poor lateral bending resistance in the complete filament yarn. The tendency to pilling of knitted or woven fabrics decreases also considerably with dropping lateral bending resistance; but as can be already seen from the expression "lateral bending resistance", it is normally impossible to manufacture or to use applicable filament yarns having a lateral bending resistance of for example zero. When woven or knitted fabrics of particularly low tendency to pilling are required, filaments having a lateral bending resistance of, for example, less than 5 cycles may be used.

The lateral bending resistance is measured by means of the flex life tester as it is described for example by Grunewald in Chemiefasern 12 (1962), page 853. For testing the lateral bending resistance, the filaments are charged with 0.45 g/tex; the diameter of the wire being 0.02 mm for up to 6.7 dtex, 0.04 mm for up to 13 dtex, and 0.05 mm for coarser titers; the flexion is carried out at an angle of 110° at a speed of 126 cycles/min.

Filaments having a reduced lateral bending resistance, but, nevertheless, a good linear strength (longitudinal sense of the fiber) may be obtained from synthetic high polymers, e.g. by use of polymers having a sufficiently low molecular weight; for example, a lateral bending resistance of about 1,500 cycles corresponds to an average molecular weight of about 12,500, while the lower limit of processability corresponds to an average molecular weight of about 8,000. Filaments of so low a molecular weight cannot be melt-spun on an economically reasonable basis due to the low melt viscosity of the polymers; they may, however, be prepared e.g. according to German Auslegeschrift No.

1,278,688, German Offenlegungsschrift No. 1,237,727, German Auslegeschrift No. 1,720,647 or Belgian Pat. No. 667,089.

It depends on the use intended, whether all the filaments of the filament yarn may be the desired low lateral bending resistance of less than 1,500 cycles and thus produce loose filament ends or whether only a portion of the filaments has this property while the rest remains in the form of continuous filaments. In the first case, in order to attain a sufficient yarn strength, slightly tighter interlacing of the filaments has to be chosen, while in the latter case sufficient yarn strength is ensured anyway by the filaments. Filament yarns blended at 7:3 to 3:7 made from filaments having a lower lateral bending resistance (below 1,500 cycles) mixed with filaments the stability of which exceeds 1,500 (e.g. 3000 cycles), resulted in knitted or woven fabrics which excel in especially attractive appearance and touch of the product and by excellent wear as well. Furthermore, titer, profile and number of the filaments, i.e. the total titer of the filament yarn used, may be chosen deliberately according to the desired application. Most often the titer will remain within the range of from 1 to 10 dtex per filament and of below 200 dtex for the yarn, appropriate for textile application purposes; however, special purposes such as decorative fabric may also require higher titers. In the case where different filaments are used to form a yarn, their titers and cross sections may differ as well; the filaments may also consist of diverse raw materials so that their diversified properties may contribute to relize further special effects, such as additional bulk effects caused by different shrinkage, or such as those caused by use of mixture yarns or coloured twist yarns. On the other hand, the color affinity of the filaments may be adapted by suitable modification.

It is generally useful to mix the individual components while processing various filaments into a filament yarn. Mixing may take place at anyone of the different preliminary processing stages. For instance, the two kinds of filaments may be spun either from one single spinning nozzle or from two adjacent spinning nozzles as described — for example — in British Pat. No. 1,208,801. The different types of filaments may also be gathered during the drawing step. A further intense mixing may be achieved in any case by interlacing or electrostatic charge.

After the drawing, the broken filament ends partially still protrude too much from the filament yarn and, before a further processing, they must be integrated at least temporarily. Suitable processes for this purpose are all known processes for filament bonding, for example treatment with a sizing agent, twisting, or texturizing. However, twisting of the filament yarns is generally an operation requiring high wage expenditure and therefore less estimated. Interlacing by blowing with gas jets generally replaces twisting more and more in the manufacture of synthetic filaments, since this may be carried out at high throughput rates and continuously, subsequent to other process steps. Such devices for interlacing are for example described in U.S. Pat. No. 2,985,995.

The open structure of the filament yarn may be fully maintained when the filament ends are bonded by applying a sizing agent which, after weaving or knitting, may be washed off again.

When processed, the filament yarns having protruding filament ends manufactured according to the process of this invention are distinguished by the high uniformity degree of all textile technological properties over the complete length of the yarn. The protruding filament ends are uniformely distributed over the length of the yarn and are not accumulated in bunches.

The following example shows an embodiment of the process of the invention.

EXAMPLE:

A spun yarn of polyethylene terephthalate comprising 64 filaments, having a specific viscosity of 0.815 (measured at 25° C on a 1 weight % solution in a mixture of phenol/tetrachloro-ethane at a weight of 3:2) was spun from a spinning nozzle at a temperature of 300° C at an extrusion rate of 37.3 g/min. The filaments were passed, parallelly arranged in a width of 90 mm, over a roller cooled to about 10° C by passing cold water through the interior of the roller. The horizontal central axis of this roller was at a distance of 50 cm from the spinning nozzle. The angle of contact was 180°. The grooved roller had an exterior diameter of 130 mm, the depth of the grooves was 5 mm at a width of 3 mm. Twelve grooves were arranged round the circumference, having a helix angle $\alpha$ of 18°. The distance D of ridge to groove was 34 mm. The circumferential speed of 600 m/min was identical to that of the following draw-off rollers. The filaments were gathered at the finishing device before the draw-off roller pair and wound up on known wind-up devices.

A measurement taken on the filaments showed that the partial lengths having been contacted with the cooled surface had a double refraction decreased from 0.004 to 0.003, so that the filament portions having lain over the groove were of a lower drawability.

The spun material was then fed into a draw-twister. In the fed-in device of this machine, the filaments were interlaced at 130 m/min for an intense bonding, subsequently drawn at a ratio of 1:4.6, and wound on cops at 20 twists per meter. The filament yarn obtained had an average of 4 protruding ends per cm, and thus had a character similar to a staple fiber yarn.

What is claimed is:

1. A process for the manufacture of filament yarn having protruding filament ends from synthetic high polymers by melt spinning of the polymers, which comprises subjecting the multi-filaments still hot ater spinning to a sectional cooling which causes determined sections of the single filaments to have a different molecular structure, and by subsequently drawing the filaments in a ratio which is greater than corresponding to those filament sections having a lower drawing ratio, and smaller than corresponding to those filament sections having a higher drawing ratio, thus causing the formation of determined breaks which supply the desired fiber ends.

2. A process as claimed in claim 1, which comprises passing and spreading out the filaments still hot after spinning, up to 1 m, and especially 25 cm, after having attained the solidification point, over the cooled surface of a profiled roller, the circumferential speed of which being the same as the speed of the running filaments, which causes determined sections of the single filaments to contact intensely the surface of the profiled roller for a determined period and thus to obtain another molecular structure than those filament sections not being in contact with the roller, and subsequently drawing the filaments in a ratio greater than corresponding to those filament sections having a lower drawing ratio, and smaller than corresponding to those filament sections having a higher drawing ratio, thus causing the formation of determined breaks supplying the desired fiber ends.

3. A process as claimed in claim 1, which comprises passing the filaments over a cooled profiled roller constructed as regular cylinder having helical grooves and ridges on the surface of its casing, which cylinder rotates with uniform angular velocity round its axis of symmetry arranged horizontally and parallelly to the plane of the filaments running parallelly one to the other, so that these filaments contact this regular cylinder longitudinally to a generating line.

* * * * *